United States Patent [19]

Hermann et al.

[11] Patent Number: 4,871,157

[45] Date of Patent: Oct. 3, 1989

[54] ZIGZAG FOLDING APPARATUS HAVING WEB CUTTER MEANS

[75] Inventors: Thomas Hermann, Darmstadt; Josef Herd, Münster; Reiner Pfuhl, Dieburg, all of Fed. Rep. of Germany

[73] Assignee: Maschinenfabrik GOEBEL GmbH, Darmstadt, Fed. Rep. of Germany

[21] Appl. No.: 135,454

[22] Filed: Dec. 21, 1987

[30] Foreign Application Priority Data

Jan. 7, 1987 [DE] Fed. Rep. of Germany ..... 3700238
Apr. 30, 1987 [DE] Fed. Rep. of Germany ..... 3714483

[51] Int. Cl.[4] ..... B41L 1/32

[52] U.S. Cl. ..... 270/39; 270/52.5; 493/359; 493/353; 493/357

[58] Field of Search ..... 270/39, 40, 41, 21.1, 270/52, 52.5, 58; 493/359, 353, 360, 357, 372, 482, 454

[56] References Cited

U.S. PATENT DOCUMENTS

| | | | |
|---|---|---|---|
| 3,784,188 | 1/1974 | DeLigt | 493/358 |
| 4,508,527 | 4/1985 | Uno | 270/40 |
| 4,700,939 | 10/1987 | Hathaway | 493/357 |
| 4,747,591 | 5/1988 | Beyer | 270/21.1 |
| 4,750,724 | 6/1988 | Herd et al. | 493/402 |

FOREIGN PATENT DOCUMENTS

| | | | |
|---|---|---|---|
| 3013865 | 1/1985 | Fed. Rep. of Germany | 493/357 |
| 3502176 | 7/1986 | Fed. Rep. of Germany | 493/359 |

*Primary Examiner*—Robert E. Garrett
*Assistant Examiner*—Therese M. Newholm
*Attorney, Agent, or Firm*—Watson, Cole, Grindle & Watson

[57] ABSTRACT

A zigzag folding apparatus has conveyors for transporting a zigzag folded web from a folding station to a discharge station, and an adjustable web cutter for separating the web at adjacent folds into groups of folded web segments during the process of transporting the web and before the web reaches the discharge station.

13 Claims, 5 Drawing Sheets

ZIGZAG FOLDING APPARATUS HAVING WEB CUTTER MEANS

BACKGROUND OF THE INVENTION

This invention relates to a zigzag folding apparatus having a web cutter for separating interconnected, zigzag folded web segments along selected foldlines thereof to form groups of such folded web segments while being conveyed toward a discharge station, the cutter being movable between extended and retracted positions between selected folds of the webs. This invention further relates to U.S. Pat. No. 4,750,724, commonly owned herewith.

Web cutters of this general type are disclosed in German Patent No. 3,013,865 and in German Published Patent Application No. 3,502,176. A continuous web is folded in some normal manner along spaced apart foldlines thereof into a zigzag fold of interconnected web segments forming a zigzag stack which may be subsequently fed through another printing device such as, for example, a speed printer for printing alphanumeric symbols on command from a data processor.

As the availability of data processing devices has increased, particularly the smaller versions, more zigzag folded webs need be made available for purchase by the average consumer interested in small zigzag folded stacks handy enough for rapid and easy transport and daily use. This has led to the demand for zigzag folded stacks having a relatively small number, about 500 to 1000, of zigzag folded web segments.

As set forth in the aforementioned German documents, it is known to cut the interconnected web segments along selected foldlines thereof to form smaller groups of interconnected, folded web segments. However, the prior art techniques require costly equipment which only leads to the provision of costly, small stacks of zigzag folded forms. The cost could be considerably reduced if the individual stacks can be made smaller in a single operation during production of the web, i.e., during the process of forming the perforated end feed strips, during printing of the web, etc.

The known zigzag folding devices are often constructed such that the continuous web to be zigzag folded leaves the folding device in a fold which is reshaped into a stack after further advancement to the discharge station. In this manner it is possible to divert the air trapped between the folded web segments especially during high production speeds, and to thereafter form stacks in the desired manner. Otherwise, for slow processing speeds for the web to be processed, a zigzag folded stack may be formed by the zigzag folding devices without first forming a scale of initially folded web segments.

SUMMARY OF THE INVENTION

It would therefore be desireable to provide small stacks using a zigzag folding device which is directly associated with a form printing machine and which works together therewith such that the web leaves the zigzag folder first in a folded scale. The folds of the scale should be banked in such manner that the cutting blade of a cutting device provided for the folding apparatus can be inserted between the folds for separating the interconnected web segments along selected foldlines thereof.

According to the invention, a zigzag folding apparatus includes a folder for zigzag folding a continuous web along spaced apart foldlines thereof to form a zigzag fold of interconnected web segments. A conveyor is mounted on the machine frame of the apparatus for supporting and transporting the zigzag fold edgewise in a forward direction from the folding station to a discharge station, the zigzag fold being banked, i.e. having a forward leaning attitude on the conveyor. A cutting apparatus on the frame is provided for separating the interconnected web segments along selected foldlines thereof to form groups of interconnected, folded web segments before reaching the discharge station. Such cutting apparatus comprises a web cutting device mounted on the machine frame for pivotal movement about an axis perpendicular to the forward direction of the folded web, the device including a web cutting element and being movable between extended and retracted positions between selected folds of the webs to effect cutting or separation along the selected foldlines. The extended path of the cutting element is angled essentially to the forward leaning attitude of the web folds to permit entry of the element between adjacent web segments. The conveyor comprises a plurality of first conveyors movable at a predetermined speed, a second conveyor movable at a different speed, preferably lower than such predetermined speed, the second conveyor being initially retracted relative to one of the first conveyors and being located adjacent the discharge station. A portion of the second conveyor, upstream of the discharge station, is shiftable relative to the one conveyor for supporting the zigzag fold by such shifted portion to delay movement to the discharge station for achieving groups of scales. A portion of the one conveyor, downstream of the shiftable second conveyor portion, conveys the separated groups of zigzag folded web segments to the discharge station.

A flap element mounted on a machine frame for movement in the forward direction may be provided so as to extend toward the zigzag fold for lifting one of the folds to facilitate the entry of the cutting element.

With the present arrangement, it is no longer necessary to first form relatively large zigzag folded stacks and to thereafter divide such stacks in a further processing operation. Instead, smaller zigzag folded stacks are obtained without further processing and in a single operation during which the forms are transported as they leave the folding device which is located downstream of the printing machine operating at high running speeds. Moreover, it is not only possible to divide a stack into smaller stacks, but to also divide into smaller stacks at such time as the stacks are supported on the conveyor relatively loosely. Thus, stacks of a precise number of segments which are sufficiently accurate for most requirements, are formed. Generally, the scale of folds is the same as the scale leaving the zigzag folding device of a form printing machine. With the present arrangement, it is also possible to considerably lower the production costs for the production of smaller, subsequent zigzag shaped stacks if during the production of the forms the already available folding devices are employed.

DETAILED DESCRIPTION OF THE INVENTION

For the sake of clarity, the several embodiments according to the invention are illustrated without any inessential machine parts.

Figure 1:
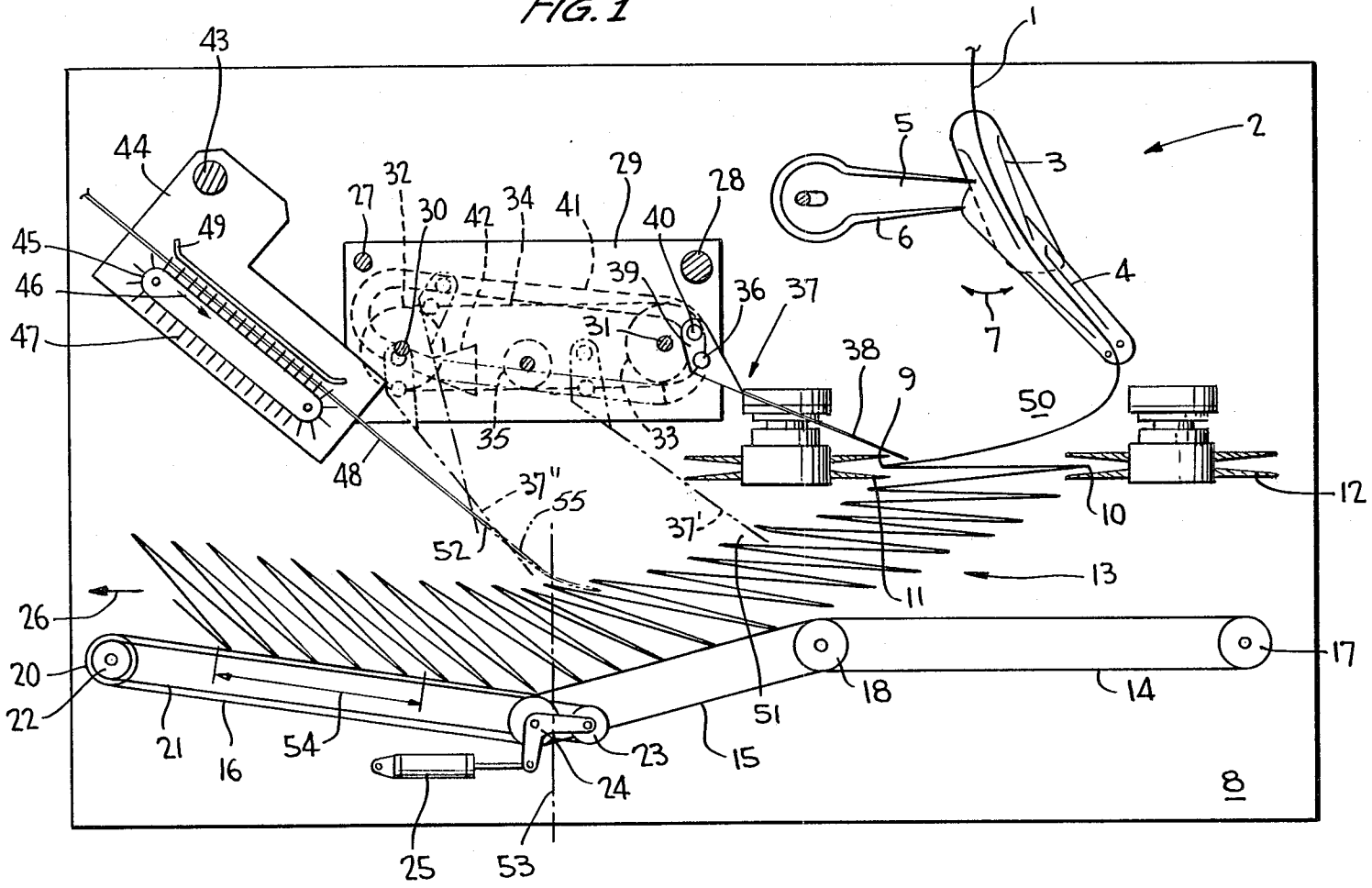
FIG. 1 is a schematic view in side elevation, partly sectioned, of a first embodiment of the apparatus according to the invention.

A continuous web 1 of paper, plastic, metal foil, or the like, which may consist of one or several overlying layers, proceeds from an upstream form processing machine (not shown) and enters a zigzag folding device, generally designated 2 in FIG. 1 and being of known construction. Such a device may include open channels 3 and 4 mounted for back and forth movement in the direction of curved double arrow 7 by means of eccentrically driven cranks 5 and 6. Folding device is mounted for such pivotal movement on a side wall 8 of the machine frame and on a parallel side wall (not shown) of the frame.

As the folding channels 3 and 4 pivot back and forth, web 1 is folded in the known manner along its spaced apart foldlines 9 and 10 formed typically by crosslines of perforations delimiting web segments along which the web is folded as it is grasped by rotating folding spirals 11 and 12. In such manner a folding scale 13 is formed by the zigzag stack of folded segments of the web which overlie one another. Folding spirals 11 and 12 are mounted on side wall 8 of the machine or on cross beams which interconnect the opposing machine side walls, in such a manner that they can be adjusted vertically to the position of foldlines 9 and 10.

After the folding process the folded scale is supported and transported on conveyor belts 14, 15, 16 which together form a first conveyor system. Each of belts 14, 15, 16 typically comprise a plurality of narrow, spaced endless belts such that conveyor belts 14 are interdigitated with belts 15, and belts 15 are similarly interdigitated with belts 16.

Belts 14 are looped around guide rolls 17 and 18, belts 15 are looped around guide rolls 18 and 19, and belts 16 are looped around guide rolls 19 and 20.

Belts 14, 15, 16 are rotated by some suitable means (not shown) at a predetermined speed which is generally required for the discharge of the folded web from the zigzag folding station to a discharge or stacking station (not shown) after leaving belts 16. Endless, spaced apart belts 21, comprising a second conveyor system, are looped around guide roll 22, arranged concentrically to guide roll 20, and around guide roll 23 which is rotatably mounted on a pivotable lever 24 mounted on the machine frame. Belts 21 alternate with belts 16, and the cylinder of a piston/cylinder unit 25 is mounted on the machine frame with its piston pivotally connected to one leg of lever 24. Upon extension of the piston, the lever is rotated counterclockwise, as viewed in FIG. 1, for raising a portion of belts 21 for supporting a stack or stacks of the zigzag folded web, as will be described more fully hereinafter. Belts 21, forming the second conveyor, are rotated in some normal manner (not shown) at a different speed, preferably lower, than the predetermined speed at which conveyors 14, 15, 16 of the first conveyor system are rotated.

When a portion of belts 21 is raised relative to belts 16, the folded web, or separated stacks, is supported on the slower moving upper run of belts 21 until continued movement of the zigzag fold reaches the downstream end of faster moving belts 16 of the first conveyor system. In such manner, movement of the zigzag fold is delayed for achieving groups of scales.

Laterally extending, parallel support rods 27 and 28 extend between and are mounted on the side walls of the machine frame. A side wall 29 of a fold lifting device is mounted on support rods 27, 28 for crosswise adjustment therealong. Another such side wall, paired with wall 29, may likewise be provided, and additional wall pairs 29 for additional lifting devices may likewise be provided.

Shafts 30 and 31 are mounted for rotation on wall or walls 29, one of such shafts being driven by a drive motor (not shown) which may likewise be attached to wall 29. Pulleys or belt wheels 32 and 33 are respectively mounted on shafts 30 and 31 for rotation together therewith, and an endless belt 34 is looped around the pulleys. An idler Pulley 35 may likewise be mounted for rotation on wall 29. The endless belt has a clip or a plug 36 thereon to which a flap member 37 is pivotally connected. The flap therefore travels together with belt 34 during its movement about pulleys 32, 33. The flap has a first lever arm 38 extending outwardly of a second lever arm 39 by which the flap member is connected to belt 34. The second lever arm has a cam roller 40 in rolling engagement with a curved, closed track 41 provided on the surface of wall 29. Of course, alternate means could be provided such as a rotating cam plate, if desired. The track can be closed as illustrated in the drawing by dashed and phantom lines. Otherwise, an open track can be provided as shown by the broken lines only.

Belt 34 is moved about its rollers in a clockwise direction viewed in FIG. 1, such that the lower run of the belt moves in the same direction of the folded scale shown by arrow 26. If an open track is provided, a funnel 42 mounted on wall 29 is provided at the entry of the interrupted track adjacent shaft 30, and in the path of cam roller 40 for feeding the cam roller back onto the track. Since the contour of the track and that of chain 34 are not coincident, and by the provision of an open track, pivoting movement of flap member 37 can be selected over a wide range since its cam roller leaves the track in the position shown and is again fed back onto the track by the funnel for continued movement along the upper run of the track.

Another rod support 43 extends between and is mounted on the lateral sidewalls of the machine frame, and a cutter holder 44 is mounted on rod 43 for adjustment therealong. A pair of such holders may be similarly provided. A tractor belt 45 having spaced pins is mounted on holder 44 and is driven in some suitable manner for movement of its upper run in the direction of arrow 46. The tractor pins project through slide feed holes (not shown) provided in a flexible and bendable cutting element 48, which may be of metal or synthetic material. A hold-down plate 49 on holder 44, typically having an elongaged slot (not shown) through which the pins project, holds down the cutting element on the tractor pins during the extended and retracted movements of the cutting element upon operation of the tractor belt. Thus, cover 49 and tractor belt 45 together provide a guide device, pivotable and adjustable about rod support 43.

During the back and forth pivotal movement of folding channels 3 and 4, the number of pivoting motions is registered by a suitable calendar (not shown). When a predetermined number is counted, belt 34 is driven by means of its drive in such a manner that first lever arm 38 of flap member 37 extends into area 50 of the forming scale. Thus, the next fold of the web formed in area 50 overlies lever arm 38 which thereby marks the location at which the folded web is to be separated into groups while being supported on the conveyors. As flap member 37 moves to its position 37' upon continued clockwise movement of belt 34, a small opening 51 is thereby formed between adjacent folds as the folded stack is transported by the first conveyor system. When the scale has moved far enough in the direction of arrow 26, the flexible and bendable cutting element 48 can, due to the rotation of the tractor belt in the direction of arrow 46, be extended for insertion into open space 51, first tangentially to arm 38. Upon further entry into space 51, cutting element 48 bends upon impacting against the folded web and follows a non-linear track. When cutting element 48 has penetrated far enough into space 51, due to the clockwise movement of the tractor belt, its cutting edge 52 separates the web segments along the small connecting ties therebetween, as the cutting element extends through the fold depth of the folded web until its cutting edge reaches the conveyor on which the web is supported. Since holder 44 is pivotable about its rod support 43, and since the cutting element is flexible and bendable, the cutting element can follow the moving folded web during its course of insertion and cutting. Thus, motion track 55 of cutting edge 52 is not along a straight line. When the cutting element has about reached a vertical position 53, pressure cylinder 25 is activated so that the slower rotating second conveyor system 21 is partially lifted for supporting a portion of the fold scale 13 which has now been separated from the zigzag fold. Thus, the separated group of interconnected folded web segments is supported only on the slower moving conveyor and piles up with the aid of cutting element 48 and the second conveyor system. Since portion 54 of the downstream folds is supported on the faster moving belts of the first conveyor system, this portion 54 is transported relatively more rapidly in the direction of arrow 26 toward the discharge station. The separated groups of web segments may therefore be transported to the discharge area at timed intervals sufficiently spaced for the groups of zigzag folded webs to be separately stacked.

Since track 41 can be interrupted as shown in phantom outline, cam roller 40 is not forced to follow the track. Flap member 37 therefore pivots downwardly and follows the fold scale 13 while its first lever arm continues to hold open space 51 for insertion of the cutting element. During continued rotation of belt 34, cam roller 40 enters catch funnel 42 so as to be led back onto track 41, and flap member 37 is brought into readiness position from which it can then again extend into opening 50, when such has been indicated by the counter operating together with pivoting channels 3 and 4.

The flap member 37 can be otherwise mounted than shown in FIG. 1, without departing from the invention. For example, the flap can be pivotally connected to a rotatable, revolving support element. Also, cutting element 48 may be extendable and retractable relative to the first conveyor system by means other than tractor belt 45 as, for example, by being suspended on a remote fulcrum by means of a lever arm so that the cutting edge of the cutting element can be moved along the circular track. And, it should be pointed out that drives and controls for the conveyor systems, the raising and lowering of a portion of second conveyor, the stopping, rotation and speed of belt 34, the tractor feed and the counter of folding segments of the web and the movement of folding channels 33 and 34, can be provided in any normal manner and are not specifically illustrated in the drawings.

Figure 2:
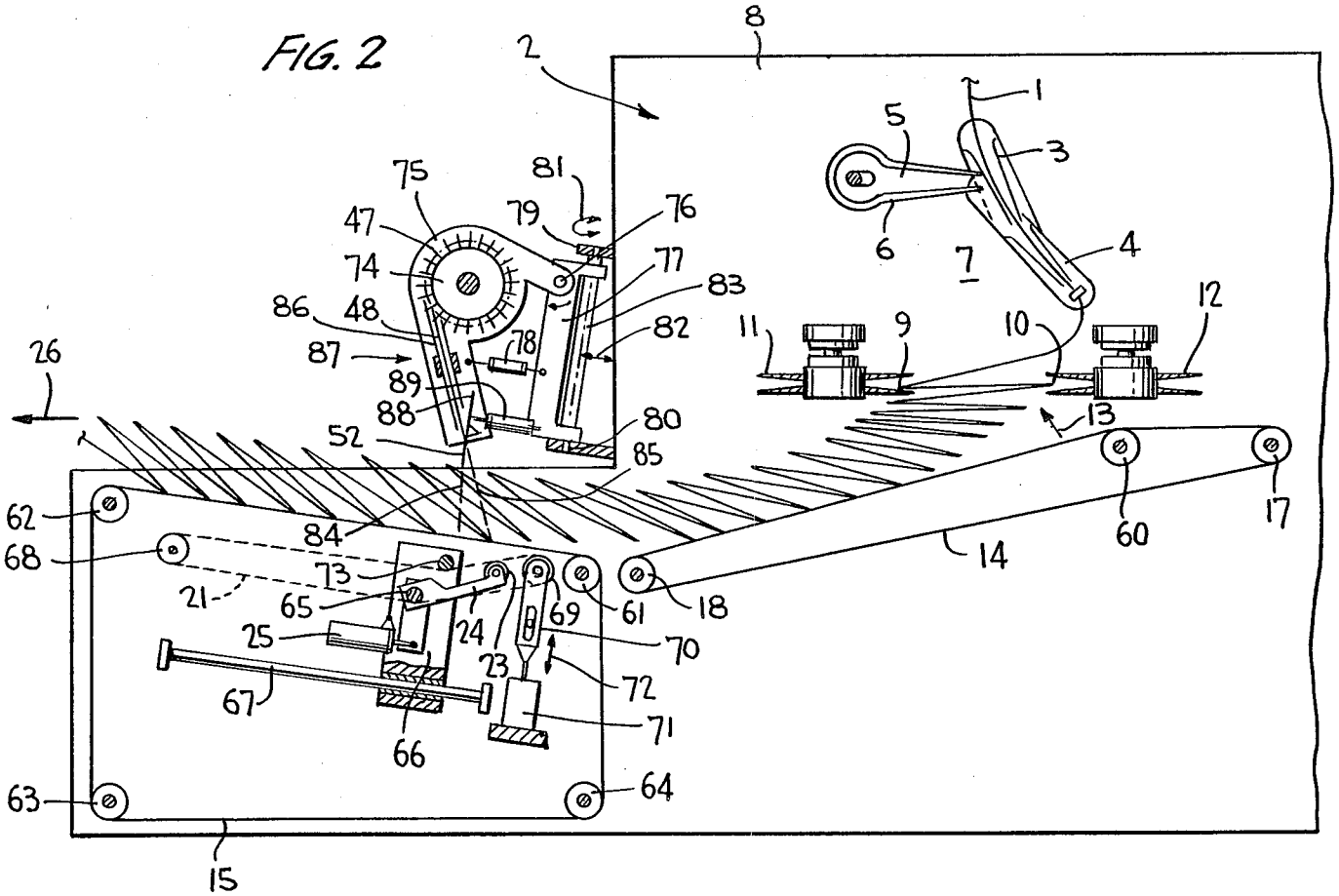
FIG. 2 is a view similar to FIG. 1 of a second embodiment of the apparatus of the invention.

The zigzag folding apparatus according to the FIG. 2 embodiment has elements in common with that of FIG. 1 and is identified by corresponding reference numerals. Conveyor belt or belts 14 of the first conveyor system are looped around guide rolls 17, 18 and 60, and belt or belts 15 of the first conveyor system loop around guide rolls 61 to 64. Thus, the first conveyor system of the FIG. 2 embodiment comprises only belts 14 and 15. Pivoting lever 24 is mounted for pivotal movement on a pin 65 which is mounted on a slideable support 66 mounted for sliding movement along a guide rod 67 by means of a suitable drive. The guide rod is mounted on the machine frame and is arranged parallel to the upper run of belt or belts 15. Support 66 can be shifted along rod 67 at variable speeds by some sort of variable drive (not shown).

The belt or belts 21 of the second conveyor system are looped around guide rolls 68 and 69, the belts 21 being spaced apart, and belts 15 likewise being spaced apart such that a portion of belts 21 can be extended through the spaced belts 15. Roll 68 is mounted on the machine frame, and roll 69 can likewise be mounted on the machine frame or can be mounted on a holder 70 which is capable of being shifted in the direction of double arrow 72 by the provision of a pressure cylinder 71. An idler roll 73 is mounted on support 66 in engagement with the upper run of belts 21. As in the FIG. 1 embodiment, the speed at which the belts of the first conveyor system travels is different, preferably higher, than the travel speed of the second conveyor system. Or, the speed of travel of the second conveyor system can be higher than that of the first conveyor system.

Upon operation of pressure cylinders 25 and 71, a portion of belts 21 can be raised so that the upper run thereof supports a group of interconnected web segments of a zigzag fold separated from the remainder of the fold. It can be seen that movement of support 66 toward the left in FIG. 2 increases the run of upper belts 21 which can be extended through the spaced belts 15 upon actuation of cylinder 71. The support surface of belts 21 can therefore be accordingly adjusted. In such manner, the zigzag fold can be stacked or partially set upright on at least a part of its path toward the discharge station. Thus, cutting element 48 may more easily be inserted between adjacent web segments formed by folds 9 and 10 of the zigzag folded strip to be piled.

Since cutting element 48 is flexible or bendable and has tractor feed holes along opposite edges, it is capable of being rolled up by tractor pins 47 of a tractor drum 74. The rearward end of the cutting element has its tractor feed holes engaged by the tractor pins such that, upon rotation of drum 74, as controlled by a step motor and a corresponding control (not shown), the cutting element can be rolled onto drum 74 for retracting the cutting element away from the conveyor, and can be unwound from drum 74 for extending the cutting element toward the conveyor.

Drum 74 and its drive are suitable mounted on a holder 75 which is pivotally mounted via a pin 76 onto a holder 77. Holder 75 can be pivoted about pin 76 by a pressure cylinder 78 and a corresponding control. Holder 77 is mounted on the machine frame for swivelling movement about hinges 79 and 80 so as to be pivotable in the direction of double arrow 81 about an axis 83 which is essentially vertical or lies at an acute angle 82 to the vertical.

A guide channel 86 of a guide device 87 is mounted on holder 75 for guiding cutting element 48 along the desired track, such as 84 or 85. The guide channel comprises spaced guide plates lying on opposite sides of the cutting element, and the guide device includes a flap 88 connected to a pressure cylinder 89 and being pivotable about a pivot 90 on holder 75. Thus, by operation of pressure cylinders 88 and 89 the track along which the cutting element moves can be adjusted and preset as desired within wide ranges. Thus, it is assured that the cutting element can enter essentially tangentially between adjacent fold segments of the zigzag folded web and can follow the course of the scale 13 in the direction of arrow 26 even when the cutting element extends through essentially the entire depth of the zigzag fold. Since the cutting element is flexible, can be extended and retracted by operation of tractor roller 74, it can follow the course of moving scale 13 for a certain distance and can be pivoted about pin 76.

As in the FIG. 1 embodiment, the cutting element extends fully into the edgewise supported zigzag folded web for severing the connecting ties at the foldlines between the web segments so as to separate the folded web into groups of a predetermined size.

The swivelable holder 77 improves ease of access to folding spirals 11 and 12. And, in lieu of a single holder 75, two parallel holding devices 77 may be provided. Means other than a counter may be provided to indicate the time and place for insertion of the cutting element into the moving fold, and it is possible to utilize colored markings, such as colored strips supplied to the fold. Instead of a pivotable attachment for the holder supporting the cutting element, other attachments may be provided to effect a straight line guide for the cutting element relative to the fold or to effect a tangentially related guide.

Figure 4:
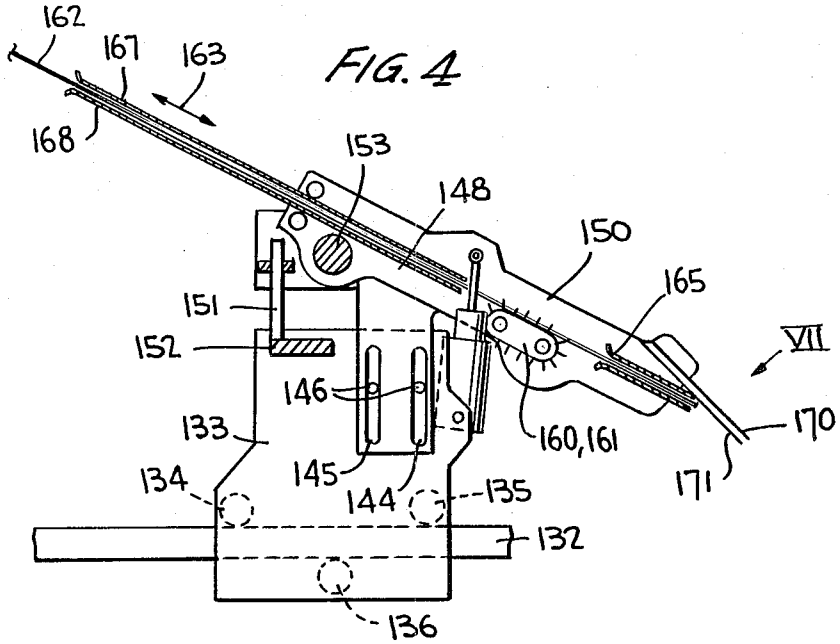
FIG. 4 is a detail view, in side elevation, of the cutting apparatus of the FIG. 3.
Figure 5:
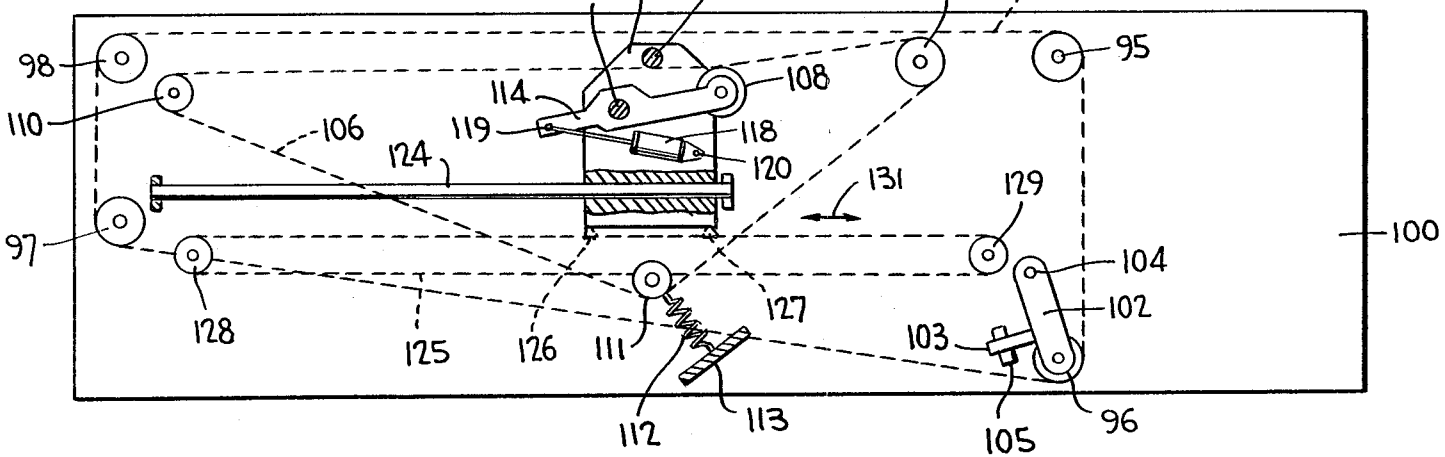
FIG. 5 is a view taken substantially along the line V—V of FIG. 6.
Figure 6:
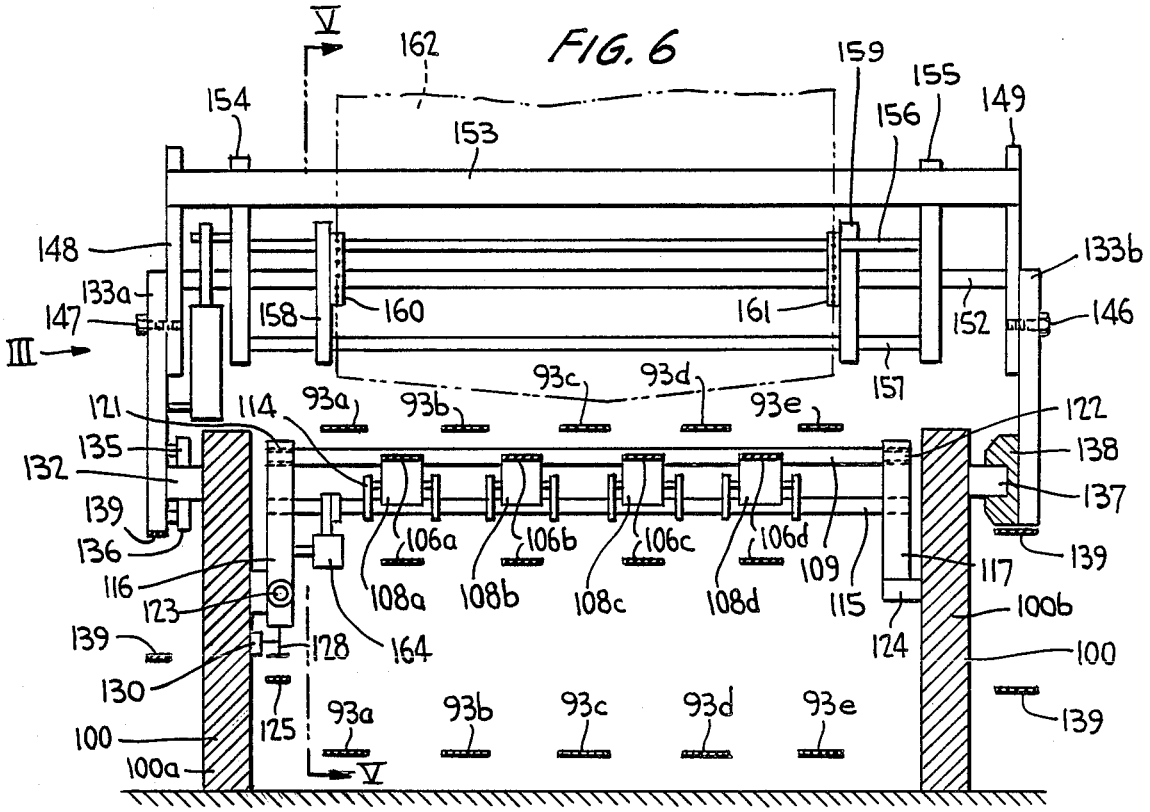
FIG. 6 is a sectional view taken substantially along the line VI—VI of FIG. 3.

In the FIGS. 3 to 7 embodiment, the first conveyor system comprises belt or belt groups 91, 92, 93. Belts 91, 92 are interdigitated as are belts 92, 93. FIG. 6 shows a typical group of conveyor belts 93*a* to 93*e* which loop around guide rolls 94 to 98, the zigzag folded scale 99 being supported edgewise on the upper run of the belts of this first conveyor system which transport the fold from the folding station to the discharge station, as in FIG. 1, and at a predetermined speed of travel. Rolls 94 to 98 can be rotatably mounted on machine frame 100 directly or indirectly by the provision of a crosshead 101 as shown for roll 95. The mounting by a crosshead has the advantage that the belts can be tightened. And, for tightening the belts, at least one of the rolls, such as 96, can be mounted via a pair of pivotable levers 102 (FIG. 5) which are pivoted about a pivoted axis 104 by an adjustment screw 103 threaded through bearings 105 on the machine frame.

As shown in FIG. 5, the second conveyor system comprises moving belts 106*a*, 106*b*, 106*c* and 106*d* which are looped around guide rolls 107 to 111 rotatively mounted on the machine frame. One of the guide rolls, such as 111, may be mounted in such a manner that belts 106 can be tightened. For this purpose there is provided a spring 112 connected to a support 113 mounted on the machine frame.

As shown in FIG. 6, roll 108 is divided into roll segments 108*a* to 108*d* mounted on an axle 115 by pivot arms 114. Each arm is pivotable about a pivot pin 115 mounted on lateral walls 116, 117. Pressure cylinder 118 is connected at 119 to one of the pivot arms and is pivotably mounted at 120 to wall 117 such that arm 114 and thus roll segments 108 can be pivoted upon operation of cylinder 118. An idler roll 109 is mounted on walls 116, 117 and bears against the upper side of the upper run of belts 106. Roll 109 is supported in bearings 121, 122 which can however, be omitted if roll 109 is fixedly mounted in place.

Walls 116 and 117 are respectively mounted on tracks 123 and 124. Track 123 may be of circular cross-section, and track 124 may be of rectangular cross-section. Both tracks are mounted parallel to one another and extend essentially parallel to the upper run of belts 93 of the first conveyor system, i.e, essentially parallel to one portion of the path along which scale 99 of the zigzag folded web travels during the piling process. Tracks 123 and 124 are respectively connected to walls 100*a* and 100*b* of the machine frame.

Lateral wall 116 is fixedly secured at 126, 127 to an endless belt 125 mounted on machine frame wall 100*a* via pulleys or wheels 128, 129. At least one of these wheels is drivable by some suitable drive motor such as by means of a digitally controlled step motor 130 mounted on wall 100*a*. Belt 125 can therefore be shifted in the direction of double arrow 131 (FIG. 5) for shifting lateral walls 116, 117 and all the elements mounted thereon, as walls 116, 117 are shifted along guide tracks 123, 124. During such shifting movement guide roll 108 can be pivoted counterclockwise about pivot pin 115 upon operation of cylinder 118. A portion of the upper run of belts 106 are thus projected between the upper run of belts 93 for therefore supporting scale 99 on the lifted belt portion 106. Since guide roll 110 is located considerably lower than guide roll 107, the amount by which scale 99 can be lifted above the upper run of belts 93 is reduced when motor 130 is activated for shifting walls 116, 117 in FIG. 5 from right to left. If motor 130 is driven at such a speed which corresponds to the speed of movement of the zigzag folded scale 99 to be piled, and if belts 106 of the second conveyor system rotate considerably slower than belts 93 of the first conveyor system, the scale to be piled is stopped in such a manner that suitable conditions result for the entry of a cutting device into the zigzag folded web to be piled. The location at which the scale is piled travels in the same direction in which this scale is transported to its final piling area.

Figure 3:
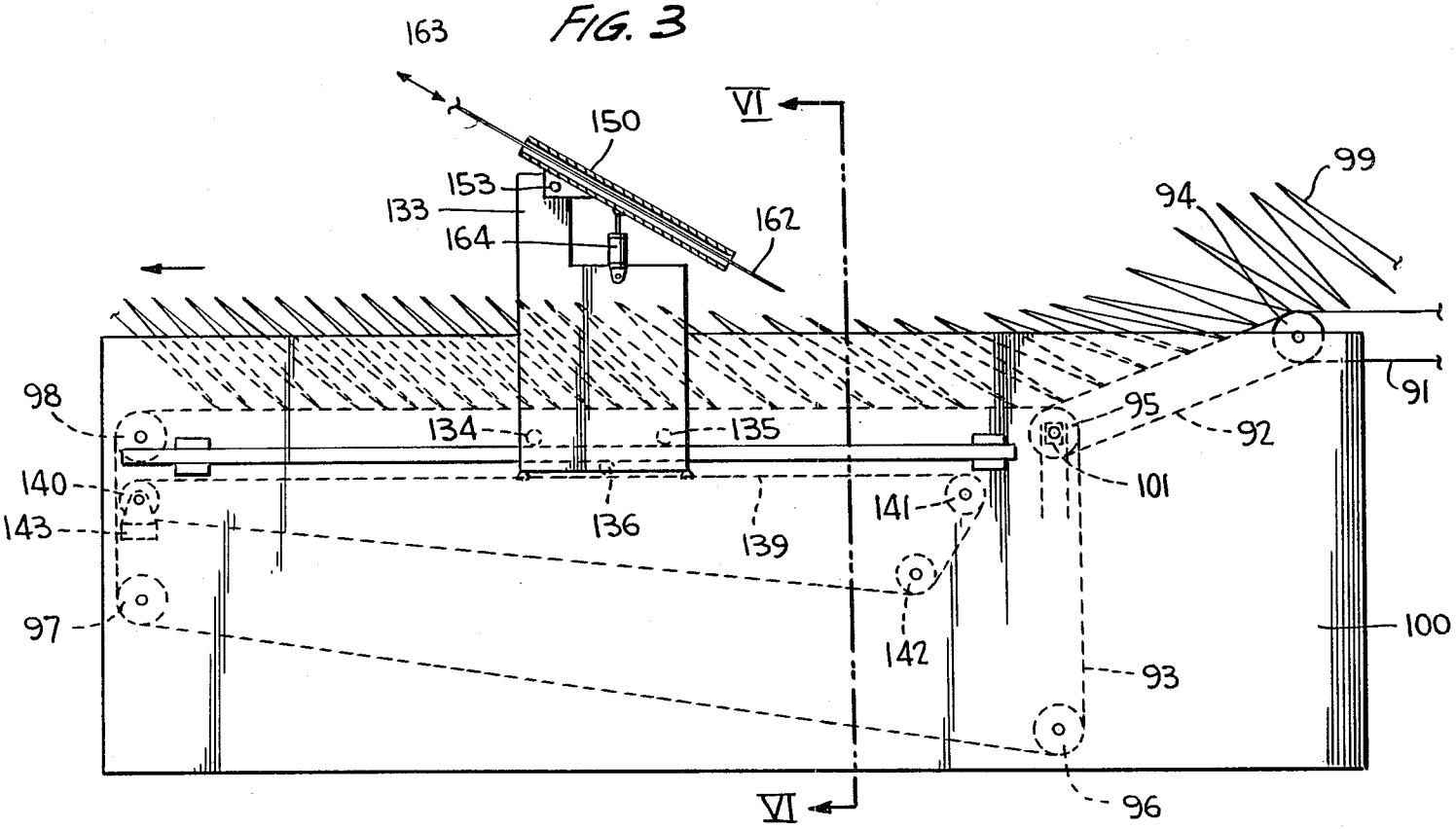
FIG. 3 is a view similar to FIG. 1 of a third embodiment of an apparatus according to the invention, when viewed in the direction of arrow III of FIG. 6.

Referring to FIGS. 3 and 6, a straight track 132 is mounted on wall 100*a* of the machine frame. This track 132 lies parallel to the path of travel of scale 99 and thus essentially parallel to the upper run of belts 93 cf the first conveyor system. Track 132 is preferably a flat track on which rollers 135, 136, rotatably mounted on a holder 133, are supported. Roller 136 may comprise a cam roller fixedly mounted on holder 133 for adjusting any play between holder 133 and track 132.

The holder comprises a pair of spaced walls 133*a*, 133*b*. Wall 133*a* rests on track 132 and wall 132*b* rests on a similar track 137, mounted on machine frame 100*b* and parallel to track 132. Track 137 may be in the form of a rail track which functions together with a corresponding shoe 138 connected to wall 133*b*. Track 137 and shoe 138 may, for example, comprise parts of a so-called star-rail guide of the Deutsch Star Kugelhalter GmbH, D-8720 Schweinfurt, Germany. This assures that the holding device 133 follows, with as little play as possible, parallel to the path of travel of scale 99 for at least a part of its travel. Walls 133*a*, 133*b* are each connected to a drive belt 139 mounted on the machine frame via rolls 140, 141, 142. At least one of the rolls for each drive belt, for example, belt 142, can be adjusted for tightening the belts. In addition, at least one of these rolls may, for example, be driven by a step motor 143 which, upon operation, moves the holding device so as to follow the scale 99 to be piled.

As shown in FIG. 4, each of the walls 133*a*, 133*b* is provided with elongated openings 144 and 145. Bolts 146 and 147 extend through these openings for supporting lateral walls 148 and 149 of a holder 150 for height adjustment relative to lateral walls 133*a*, 133*b*. Adjustment of holder 150 toward holder 133 is effected by an adjustment screw 151 which is threaded through at one end of a bearing on walls 148, 149 and which abuts at its other end against a cross-support 152 which spans walls 133*a*, 133*b*. Several such adjustment screws may be provided, if desired. Lateral walls 148, 149 (see also FIG. 6) are interconnected by a round crossbeam 153. Lateral walls 154 and 155 are supported on this crossbeam, and these lateral walls are interconnected by tracks 156 and 157. Walls 158 and 159 can be shifted along these tracks 156 and 157 and, as needed, secured to these tracks. Pin feed tractor bands 160 and 161 are mounted on lateral walls 158 and 159. These tractors have pin belts, the pins of which extend through feed holes located along opposite edges of a cutting element 162. The tractors can be driven in any desired manner by suitable motors (not shown) for moving the cutting element in the direction of double arrow 163 (FIG. 4). Walls 148 and 149 of holder 150 can, if necessary, be pivoted about the axis of crossbeam 153 by means of a pressure cylinder 164. Also, holder 150 has pairs of guide channels 165, 166 and 167, 168 for guiding the cutting element.

Figure 7:
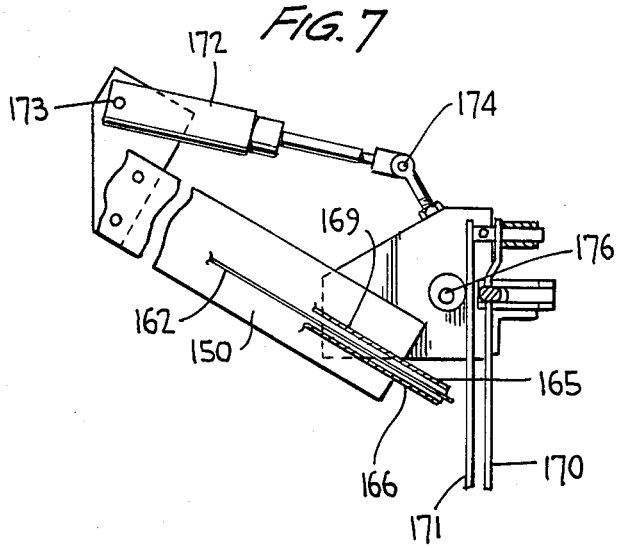
FIG. 7 is a detail view taken in the direction of arrow VII of FIG. 4.

A gripping device is mounted at the lower end of holder 150, as shown in FIG. 4 and more detail in FIG. 7. This device includes upper and lower grippers 170 and 171 mounted on holder 150 for pivotal movement on a pivot pin 169. Pressure cylinder 172 is mounted on holder 150 at pivot pin 173 and is pivotally connected atjoint 174 to a holding plate 175 on which grippers 170, 171 are mounted. A cam 176, rotated by some suitable control (not shown), is provided to adjust lower gripper 171 toward or away from gripper 170. Thus, the grippers can grasp at least one fold of the zigzag folded web to facilitate entry of cutting element 162 into scale 99. The cutting element may therefore more effectively sever the zigzag fold to provide the required separated groups.

Cover holder 150 is pivotally mounted on crossbeam 153, and pressure cylinder 164 acting between holder 150 and holder 133 may be operated to adjust the angularity of holder 150 relative to the leaning attitude of the zigzag folded web to facilitate easy entry of cutting element 162 between the folds. The angular adjustment can be set by adjustment screw 151. And, since holder 131 is adjustable along tracks 132, 137, entry of the cutting element between designated folds of the traveling web is made possible. Thus, since holder 133 may travel together with the moving zigzag folded web, the scale can be separated at a desired location by the cutting element such that any chosen number of zigzag piled segments of the folded web can be cut in the desired location with the desired number of pile segments having predetermined layers of zigzag folds and thus stacks of desired height and desired sheet number. Since the traveling speeds of the first and second conveyor systems are different, scale 99 can be piled in such a manner that the cutting element of flexible material, can safely and securly by inserted in the desired location between adjacent layers of the scale, travel with it a certain distance and cut the scale during its travel. And, since the cutting element and the rate of travel of its holder can be preset, various materials can be processed over a wide range, such as thick and thin webs, synthetic material, foils, or the like. And, since all the traveling devices are mounted in place with as little play as possible, all the operations required for cutting the scale to be piled can be executed with precission. The control device and various drive motors and pressure cylinders are provided for the aforedescribed operations and ensure that all the operations are carried out acurately in timed sequence and to the required extent. Such control device (not shown) may comprise, for example, a microprocessor and corresponding auxiliary devices.

The cutting edge of the cutting element may be angled or may be pointed (as shown in FIG. 6) for assuring clean separation between folds of the web. Otherwise, the cutting element may have cutting teeth in some desired form. And, it is possible to combine the various features of the third embodiment with those of the first and/or second embodiments without departing from the invention.

What is claimed is:

1. A zigzag folding apparatus, comprising a machine frame, means at a folding station for zigzag folding a continuous web along spaced apart foldlines thereof into a zigzag fold of interconnected web segments, conveyor means on said frame for supporting and transporting the zigzag fold edgewise in a forward direction from said folding station to a discharge station, the zigzag fold having a forward leaning attitude on said conveyor means, an apparatus for separating the interconnected web segments along selected foldlines thereof form groups of interconnected, folded web segments before reaching the discharge station, said separating apparatus comprising a web cutting device including a flexible web cutting element and means for moving said element between extended and retracted positions between selected folds of the webs, said element being angled essentially to said forward leaning attitude to permit entry of said element between adjacent web segments in an initial extended position thereof, said web cutting device being mounted on said frame for pivotal movement about an axis perpendicular to said forward direction to permit said cutting element to pivot and due to its flexibility to flex for matching the attitude of the moving zigzag fold after said entry thereof to effect web separation, said conveyor means comprising a plurality of first conveyors movable at a predetermined speed, a second conveyor movable at a speed lower than said predetermined speed, said second conveyor being initially retracted relative to one of said first conveyors and being located adjacent said discharge station, means for shifting a portion of said second conveyor relative to said one conveyor for supporting the zigzag fold by said portion to delay movement to said discharge station for achieving groups of scales.

2. The apparatus according to claim 1, further comprising a flap element mounted on said frame for movement in said forward direction, said flap element extending toward the zigzag fold for supporting an end of one of the folds adjacent said folding station and moving together with the zigzag fold to form an opening to facilitate the entry of said cutting element.

3. The apparatus according to claim 2, wherein said flap element is mounted on said frame by means of an endless drive chain having a lower run movable in said forward direction.

4. The apparatus according to claim 3, wherein said flap element has a cam roller, and means defining a track being mounted on said machine, said cam element being attached to said chain and said roller engaging said track during movement of said chain.

5. The apparatus according to claim 4, wherein the path of said chain and the path of said track are relatively offset so as not to coincide.

6. The apparatus according to claim 1, wherein said web cutting device includes means for guiding said cutting element between said extended and retracted positions, and means for adjusting said guiding means to facilitate the entry of said cutting element.

7. The apparatus according to claim 1, wherein said means for moving said cutting element comprises a winding device about which said cutting element is wound and unwound.

8. The apparatus according to claim 7, wherein said separating apparatus further comprises a support bracket on which said cutting device is pivotally mounted, said bracket being mounted on said machine frame for pivotal movement about an axis perpendicular to said axis of said device.

9. The apparatus according to claim 1 further comprising means for adjusting said web cutting device to adjust the angle thereof to said forward leaning attitude.

10. A zigzag folding apparatus comprising, a machine frame, means at a folding station for zigzag folding a continuous web along spaced apart foldlines thereof into a zigzag fold of interconnected web segments, conveyor means on said frame for supporting and transporting the zigzag fold edgewise in a forward direction from said folding station to a discharge station, the zigzag fold having a forward leaning attitude on said conveyor means, an apparatus for separating the interconnected web segments along selected foldlines thereof to form groups of interconnected, folded web segments before reaching the discharge station, said separating apparatus comprising a web cutting device mounted on said frame for sliding movement parallel to said forward direction, said device including a holder slideably mounted on said frame and a web cutting element, means mounted on said holder for guiding said element between extended and retracted positions relative to said conveyor means, and means for pivotally adjusting said element about an axis perpendicular to said forward direction, said element being angled essentially to said forward leaning attitude to permit entry of said element between the folds of adjacent web segments in said extended position thereof, said conveyor means comprising a plurality of first conveyors movable at a predetermined speed, a second conveyor moveable at a speed lower than said predetermined speed, said second conveyor being initiallyh retracted relative to one of said first conveyors and being located adjacent said discharge station, means for shifting a portion of said second conveyor relative to said one conveyor for supporting the zigzag fold by said portion to delay movement to said discharge station for achieving groups of scales.

11. The apparatus according to claim 10, wherein said cutting element is of flexible material.

12. The apparatus according to claim 10, further comprising web gripping means mounted on said guiding means for grasping a zigzag fold to facilitate the entry of said cutting element.

13. The apparatus according to claim 10, further comprising a guide track mounted on said frame parallel to an upper support run of said first conveyors, said separating apparatus being mounted on said track for sliding movement therealong.

* * * * *

UNITED STATES PATENT AND TRADEMARK OFFICE

CERTIFICATE OF CORRECTION

PATENT NO. : 4,871,157

DATED : October 3, 1989

INVENTOR(S) : Hermann THOMAS, Josef HERD, and Reiner PFUHL

It is certified that error appears in the above-identified patent and that said Letters Patent is hereby corrected as shown below:

In the title page, correct the name of the first-named inventor to read -- Hermann Thomas --.

Signed and Sealed this

Second Day of October, 1990

*Attest:*

HARRY F. MANBECK, JR.

*Attesting Officer*

*Commissioner of Patents and Trademarks*